US006672265B2

(12) United States Patent
Todo et al.

(10) Patent No.: US 6,672,265 B2
(45) Date of Patent: Jan. 6, 2004

(54) VALVE TIMING CONTROL SYSTEM FOR INTERNAL COMBUSTION ENGINE

(75) Inventors: Tamotsu Todo, Kanagawa (JP); Kazuhiko Takayanagi, Kanagawa (JP); Shigeaki Yamamuro, Kanagawa (JP); Naotaka Nakura, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/267,864

(22) Filed: Oct. 10, 2002

(65) Prior Publication Data

US 2003/0070642 A1 Apr. 17, 2003

(30) Foreign Application Priority Data

Oct. 16, 2001 (JP) ..... 2001-317653

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS 6,502,537 B2 * 1/2003 Todo et al. ..... 123/90.17
6,510,826 B2 * 1/2003 Watanabe ..... 123/90.17
6,561,149 B1 * 5/2003 Kobayashi et al. ..... 123/90.17
2002/0100444 A1 8/2002 Todo et al.

FOREIGN PATENT DOCUMENTS

JP 2001-41013 A 2/2001

OTHER PUBLICATIONS

U.S. patent application Ser. No. 10/267,678, Hibi et al., filed Oct. 10, 2002.
U.S. patent application Ser. No. 10/267,866, Watanabe et al., filed Oct. 10, 2002.
U.S. patent application Ser. No. 10/267,776, Watanabe et al., filed Oct. 10, 2002.

* cited by examiner

*Primary Examiner*—Thomas Denion
*Assistant Examiner*—Zelalem Eshete
(74) *Attorney, Agent, or Firm*—Foley & Lardner

(57) ABSTRACT

In a valve timing control system, an intermediate rotator is rotated with respect to a driving plate and a lever shaft to make radial displacement of a ball engaged with a spiral slot of the intermediate rotator along a radial slot. The radial displacement is converted into relative rotation of the driving plate and the lever shaft through a link. A bottomed cylindrical guide member which is rotatably supported by a front end of the link has a base engaged with the spiral slot. The ball engaged with the spiral slot, a retainer for supporting the back of the ball, and a coil spring for biasing the ball through the retainer are accommodated in a hold hole of the guide member. Disengagement of the ball from the spiral slot is prevented by an abutment of an end face of the retainer and a bottom wall of the hold hole.

10 Claims, 8 Drawing Sheets

VALVE TIMING CONTROL SYSTEM FOR INTERNAL COMBUSTION ENGINE

BACKGROUD OF THE INVENTION

The present invention relates to a valve timing control system for an internal combustion engine, which performs variable control of opening and closing timing of an intake or exhaust engine valve in accordance with the engine operating conditions.

Typically, the valve timing control system controls opening and closing timing of an engine valve by controlling the phase of rotation of a crankshaft and a camshaft on a power transfer path from the crankshaft to the camshaft. Specifically, the system comprises a driving rotator coupled to the crankshaft through a timing chain and the like, a follower rotator coupled to the camshaft and to which the driving rotator is mounted to enable relative rotation as required, and a mounting-angle control mechanism interposed between the two rotators to control a mounting angle formed therebetween. Operating-force providing means provide an operating force to the mounting-angle control mechanism when required to change the phase of rotation of the crankshaft and the camshaft.

Various types of mounting-angle control mechanisms have been developed, one of which uses a helical gear to convert rectilinear operation of a hydraulic piston to rotary operation of the driving and follower rotators. Recently, a mounting-angle control mechanism using a link is proposed which has many advantages such as shortened axial length and less friction loss.

However, as will be described hereinafter, with the valve timing control system including a link as mounting-angle control mechanism, when the system undergoes great torque variation, for example, an engaging part of a guide member or movable guide can be disengaged from a spiral guide, disturbing smooth operation of the guide member.

SUMMARY OF THE INVENTION

It is, therefore, an object of the present invention to provide a valve timing control system for an internal combustion engine, which contributes to smooth and accurate operation of the guide member along the spiral guide at all times.

The present invention provides generally a system for controlling a valve timing in an internal combustion engine, which comprises: a driving rotator rotated by a crankshaft of the engine; a follower rotator provided to a camshaft of the engine, the follower rotator receiving power from the driving rotator; a radial guide provided to one of the driving rotator and the follower rotator; an intermediate rotator arranged rotatable with respect to the driving rotator and the follower rotator, the intermediate rotator comprising a spiral guide in a face opposite to the radial guide; a movable guide movably engaged with the radial guide and the spiral guide; a link which swingably couples another of the driving rotator and the follower rotator at a position distant from a center of rotation thereof to the movable guide; and a device which provides to the intermediate rotator an operating force for rotation with respect to the driving rotator and the follower rotator, the device making radial displacement of the movable guide engaged with the spiral guide along the radial guide, the radial displacement being converted into relative rotation of the driving rotator and the follower rotator through the link, wherein the movable guide comprises a main body supported by a front end of the link, an engaging part movably provided to the main body and engaged with the spiral guide, a biasing device which biases the engaging part to the spiral guide, and a restraining device which restrains, when backward displacement of the engaging part occurs against a force of the biasing device, the backward displacement within a range that the engaging part fails to be disengaged from the spiral guide.

BRIEF DESCRIPTIONOF THE DRAWINGS

The other objects and features of the present invention will become apparent from the following description with reference to the accompanying drawings, wherein.

DETAILED DESCRIPTION OF THE INVENTON

Figure 1:
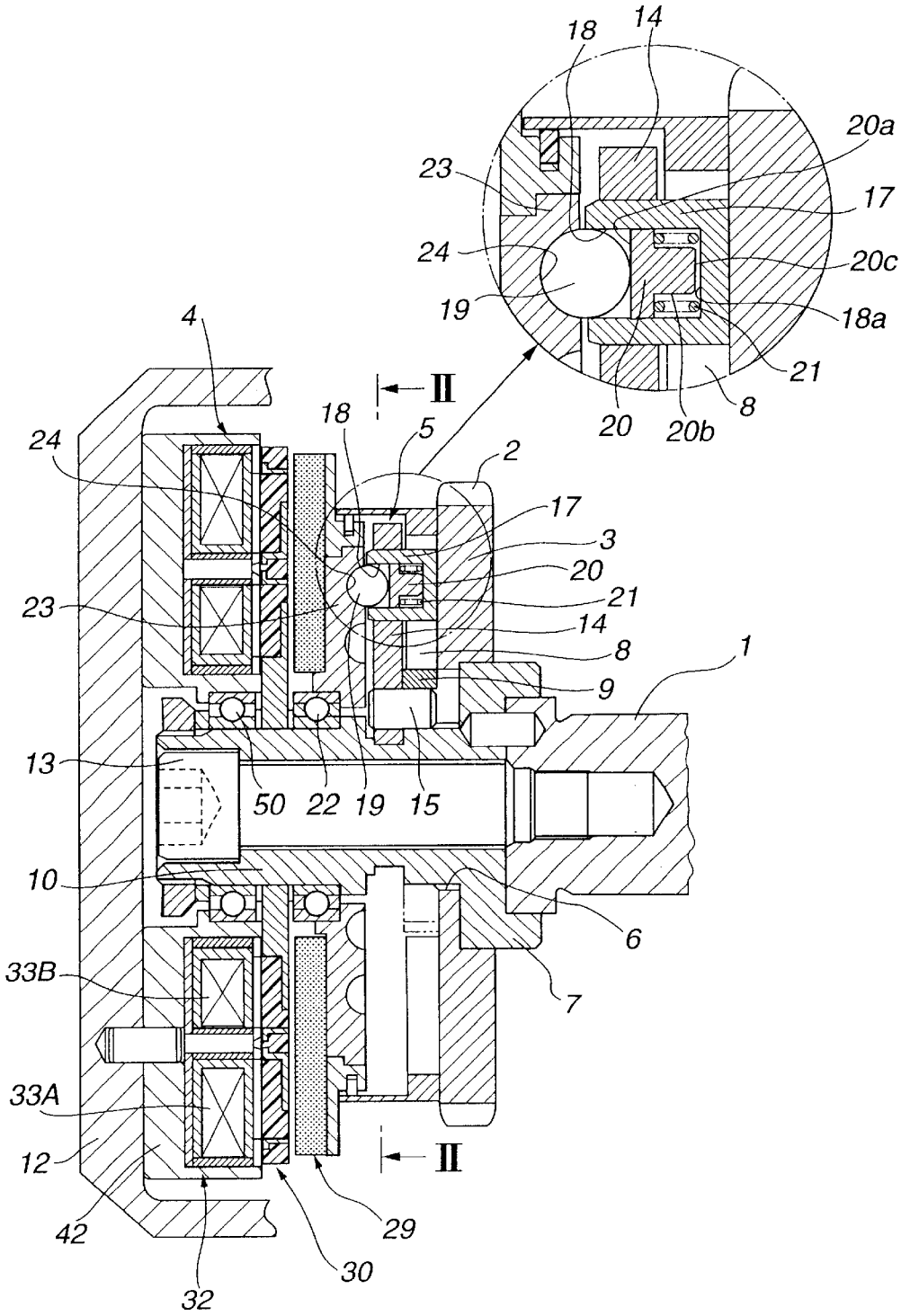
FIG. 1 is a longitudinal sectional view showing a first embodiment of a valve timing control system for an internal combustion engine according to the present invention.

Before entering a description about the preferred embodiments of the present invention, a valve timing control system disclosed in JP-A 2001-41013 is described.

The system comprises a housing or driving rotator coupled to a crankshaft through a timing chain and the like, a camshaft having an end to which the housing is rotatably mounted, guide members or movable guides radially slidably engaged with radial guides formed in the inner end face of the housing, a lever shaft or follower rotator connected to the end of the camshaft by a bolt and having levers protruding radially outward, wherein the guide member is pivotally connected to the corresponding lever of the lever shaft through a link. An intermediate rotator having a spiral guide is mounted to the housing at the position facing the radial guide so as to be rotatable with respect to the housing and the lever shaft. Roughly circular protrusions protruding from one axial end of each guide member is engaged with the spiral guide. The intermediate rotator is biased by a power spring in the rotation advancing direction with respect to the housing, and is subjected to a force out of an electromagnetic brake in the rotation delaying direction as required.

With this system, when the electromagnetic brake is turned off, the intermediate rotator is located in the initial position with respect to the housing under a biasing force of the power spring, wherein the guide member engaged with the spiral guide of the intermediate rotator through the protrusions performs maximum radially outward displacement to raise the link, maintaining a mounting angle formed between the housing and the camshaft at the maximum lag angle or the maximum advance angle. In this state, when the electromagnetic brake is turned on, the intermediate rotator is reduced in speed to perform rotation in the lag direction with respect to the housing. As a result, the guide member engaged with the spiral guide performs radially inward displacement to gradually lower the link raised so far, changing the mounting angle of the housing and the camshaft to the maximum lag angle or the maximum advance angle.

Japanese Patent Application P2001-24077 filed Jan. 31, 2001 (=U.S. patent application Ser. No. 10/042,257 filed Jan. 11, 2002) proposes an improvement in the valve timing control system to allow reduction in the slide resistance between the spiral guide of the intermediate rotator and the guide member and prevention of backlash therebetween.

The improved system has a circular recess arranged in the guide member in a face opposite to the spiral guide so as to accommodate therein balls or engaging parts, a retainer for holding the balls in a free rolling way, and biasing means for biasing the balls forward through the retainer. Thus, the movable guide is engaged with the spiral guide through balls.

With this system, however, when the system undergoes great torque variation due to the profile of a driving cam and a resilient force of a valve spring, for example, the ball pushes back the biasing means to be involved in an edge of the spiral guide, disturbing smooth operation of the guide member having balls.

Referring now to the drawings, the valve timing control system embodying the present invention is described, wherein the present invention is applied to a power transfer system on the intake side of the engine. Note that the present invention can be applied to a power transfer system on the exhaust side of the engine.

Referring to FIG. 1, the valve timing control system comprises a camshaft 1 rotatably supported to a cylinder head, not shown, of an internal combustion engine, a driving plate or driving rotator 3 mounted to camshaft 1 at the front end to enable relative rotation as required and including at the outer periphery a timing sprocket or power input part 2 linked to a crankshaft, not shown, through a chain, not shown, a mounting-angle control mechanism 5 disposed in front of camshaft 1 and driving plate 3, i.e. on the left as viewed in FIG. 1, to control a mounting angle formed between the two 1, 3, disposed in front of mounting-angle control mechanism 5 to operate mechanism 5, and a valve timing control (VTC) cover 12 attached to the front face of the cylinder head and a rocker cover, not shown, to conceal the front face of operating-force providing means 4 and mounting-angle control mechanism 5 and their neighborhood.

Figure 2:
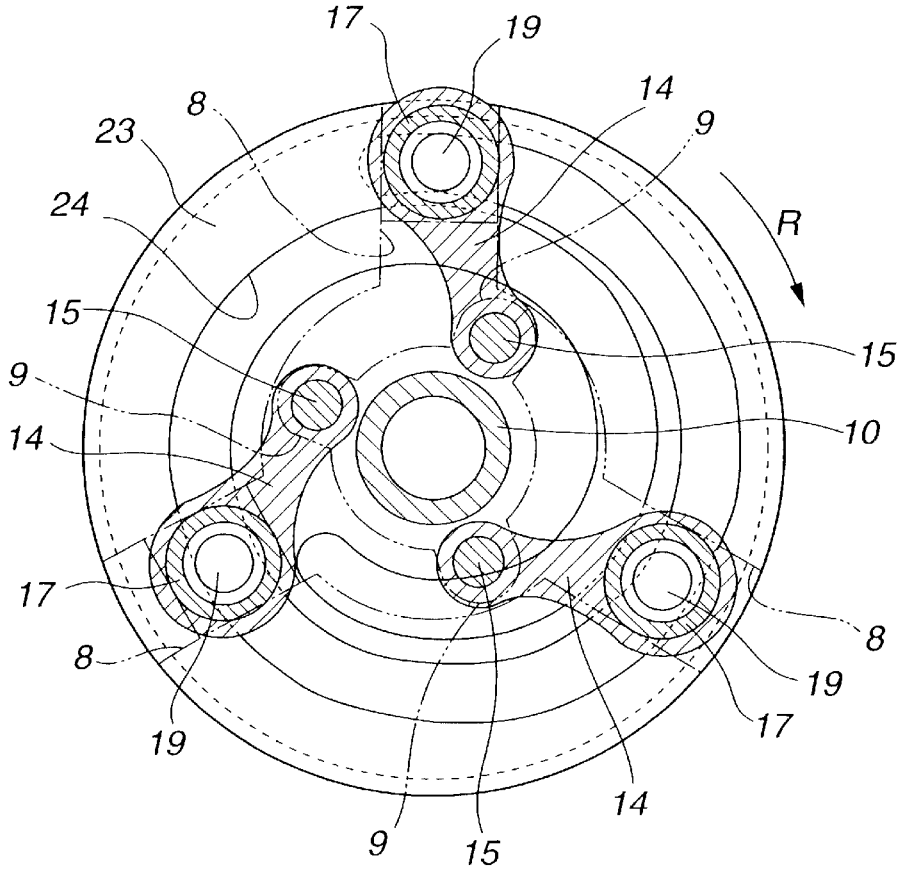
FIG. 2 is a sectional view taken along the line II—II in FIG. 1.

Driving plate 3 is formed like a disc having a through hole 6. A lever shaft or follower rotator 10 integrally connected to a front end of camshaft 1 is rotatably fitted in through hole 6. Referring to FIG. 2, three radial slots or guides 8 are formed in the front face (the far side with respect to camshaft 1) of driving plate 3 along the radial direction thereof. A guide member or movable-guide main body 17 as will be described later has a base with roughly rectangular section slidably engaged with radial slot 8.

As shown in FIG. 1, lever shaft 10 is formed with a large-diameter flange 7 at the outer periphery of the base butted to the front end of camshaft 1, and three levers 9 radially protruding to the outside in front of the flange 7 by a predetermined distance. Lever shaft 10 is connected to camshaft 1 by a bolt 13 arranged axially. Link 14 has one end pivotally coupled to lever 9 of lever shaft 10 through a pin 15, and another end rotatably supported to guide member 17 having a base engaged with radial slot 8.

In the state engaged with corresponding radial slot 8 as described above, guide member 17 is coupled to corresponding lever 9 of lever shaft 10 through link 14. Thus, when guide member 17 is displaced along radial slot 8 under an external force, driving plate 3 and lever shaft 10 perform relative rotation in the direction and by an angle corresponding to the displacement of guide member 17 under the action of link 14.

Figure 3:
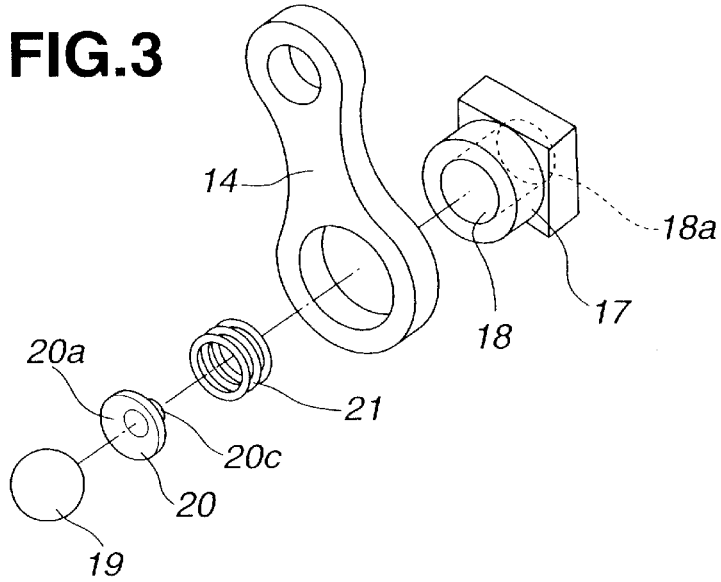
FIG. 3 is an exploded perspective view showing a link and a guide member.

Referring to FIGS. 1 and 3, a circular hold hole 18 is arranged in guide member 17 to open to the front face (the far side with respect to camshaft 1), in which a ball or engaging part 19 and a roughly cylindrical retainer 20 are slidably accommodated, and a coil spring or biasing means 21 for biasing retainer 20 forward is arranged. Retainer 20 has a front-end face 20*a* formed in a flat surface or a slightly concave sphere, and supports the back of ball 19 through front-end face 20*a*. Moreover, retainer 20 has the back formed stepwise to support an end of coil spring 21, a boss 20*b* at the front end of which protrudes inside coil spring 21. An end face 20*c* of boss 20*b* faces a bottom wall 18*a* of hold hole 18, so that when moved backward together with ball 19 by a set distance against a force of coil spring 21, retainer 20 abuts on bottom wall 18*a*. Therefore, end face 20*c* of retainer 20 constitutes an abutment to guide member 17, whereas bottom wall 18*a* of hold hole 18 constitutes a restraining wall on which end face 20*c* abuts directly. Ball 19 is of the diameter slightly smaller than the inner diameter of hold hole 18 to be guided by the inner peripheral face of hold hole 18 in a free rolling way.

Figure 8:
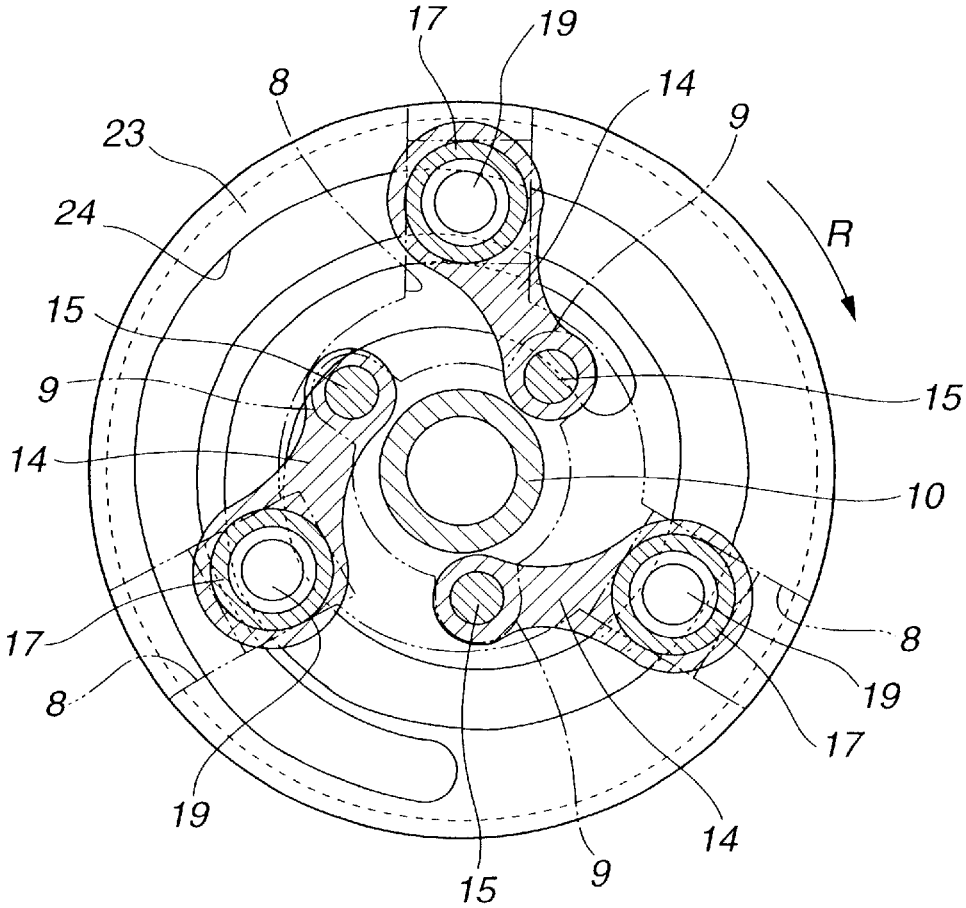
FIG. 8 is a view similar to FIG. 2, showing an operating state of the valve timing control system.
Figure 9:
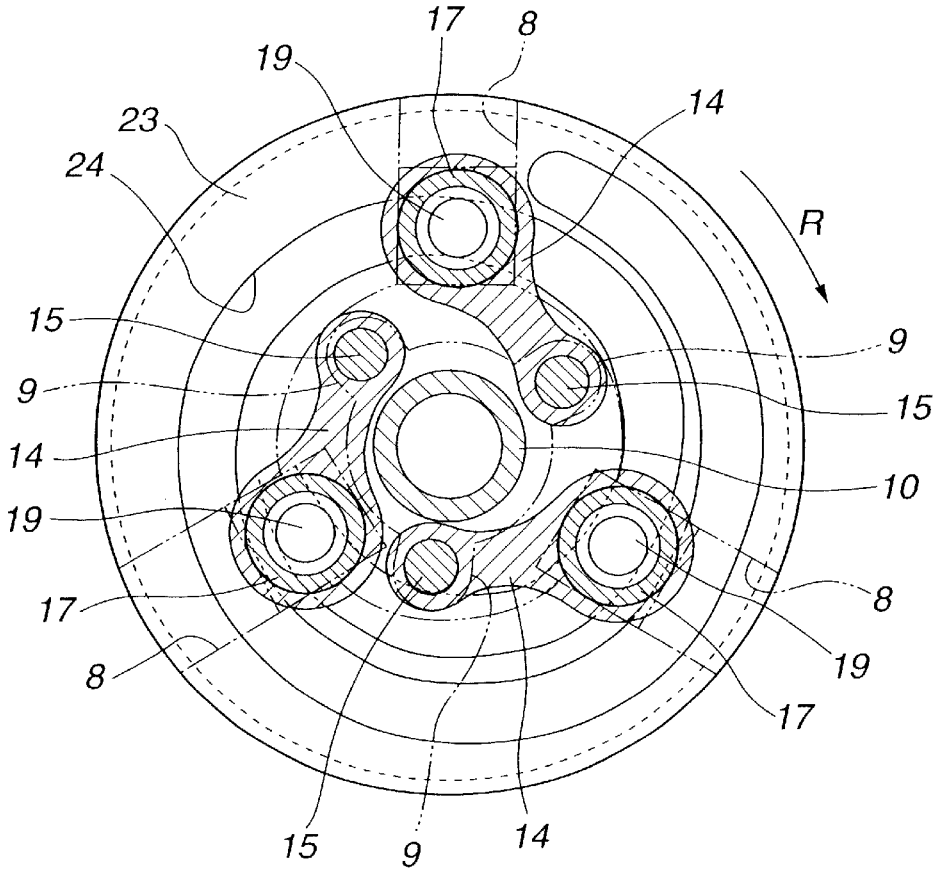
FIG. 9 is a view similar to FIG. 8, showing another operating state of the valve timing control system.

On the other hand, a roughly disc-like intermediate rotator 23 is supported to lever shaft 10 in front of the protruding position of lever 9 through a ball bearing 22. A spiral slot or guide 24 with semicircular section is formed in the rear face of intermediate rotator 23, and ball 19 held by guide member 17 is engaged with spiral slot 24 in a free rolling way. Referring to FIGS. 2, 8, and 9, a spiral of spiral slot 24 is gradually reduced in diameter along a direction of rotation R of driving plate 3. Therefore, with ball 19 of guide member 17 engaged with spiral slot 24, when intermediate rotator 23 performs relative rotation in the lag direction with respect to driving plate 3, guide member 17 is moved radially inward along the spiral of spiral slot 24, whereas when intermediate rotator 23 performs relative rotation in the advance direction, guide member 17 is moved radially outward.

A distance of separation between end face 20*c* of retainer accommodated in guide member 17 and bottom wall 18*a* of hold hole 18 in the initial state, i.e. the state that ball 19 is fully engaged with spiral slot 24, is set so that when ball 19 is moved backward against a force of coil spring 21, end face 20*c* abuts on bottom wall 18*a* before ball 19 is fully disengaged with spiral slot 24. In this embodiment, restraining means comprise end face 20*c* of retainer 20 and bottom wall 18*a* of hold hole 18.

In this embodiment, mounting-angle control mechanism 5 comprises radial slot 8 of driving plate 3, guide member 17, ball 19, link 14, lever 9, spiral slot 24 of intermediate rotator 23, etc. When operating-force providing means 4 provide to intermediate rotator 23 an operating force for rotation with respect to camshaft 1, mounting-angle control mechanism 5 radially displaces guide member 17 through spiral slot 24, and amplifies the operating force through link 14 and lever 9 up to a set magnification, providing relative torque to driving plate 3 and camshaft 1.

Figure 4:
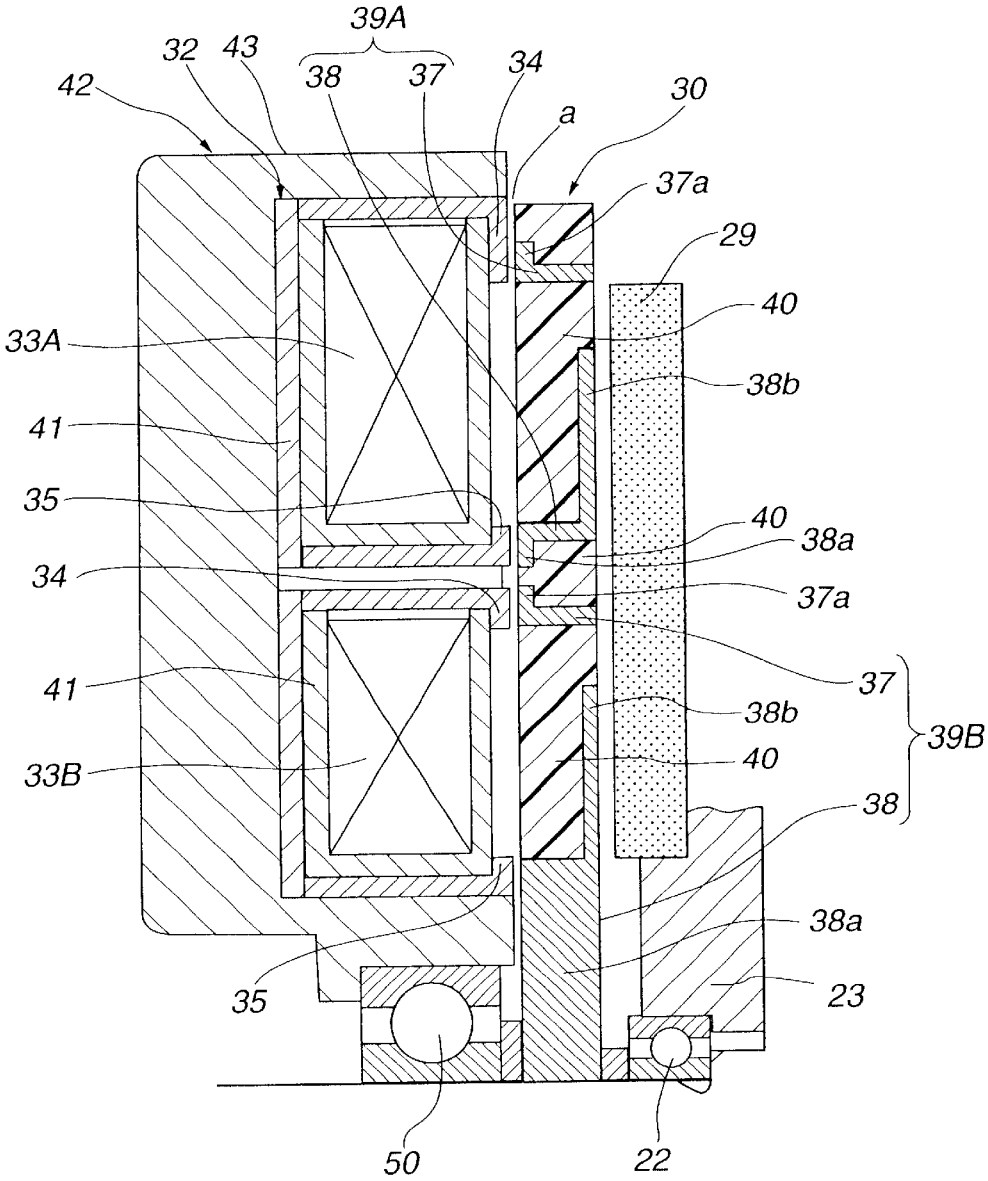
FIG. 4 is an enlarged fragmentary view of FIG. 1.

Referring to FIGS. 1 and 4, operating-force providing means 4 comprise an annular-plate-like permanent-magnet block 29 jointed to the front face (the far side with respect to driving plate 3) of intermediate rotator 23, an annular-plate-like yoke block 30 integrally connected to lever shaft 10, and an electromagnetic-coil block 32 mounted to the inside of VTC cover 12. Electromagnetic-coil block 32 comprises a plurality of electromagnetic coils 33A, 33B connected to a drive circuit, not shown, including an excitation circuit, a pulse distribution circuit and the like and controlled by an electronic control unit (ECU), not shown. The ECU receives various input signals indicative of crank angle, cam angle, engine speed, engine load and the like to provide a control signal to the drive circuit in accordance with the engine operating conditions when required.

Figure 5:
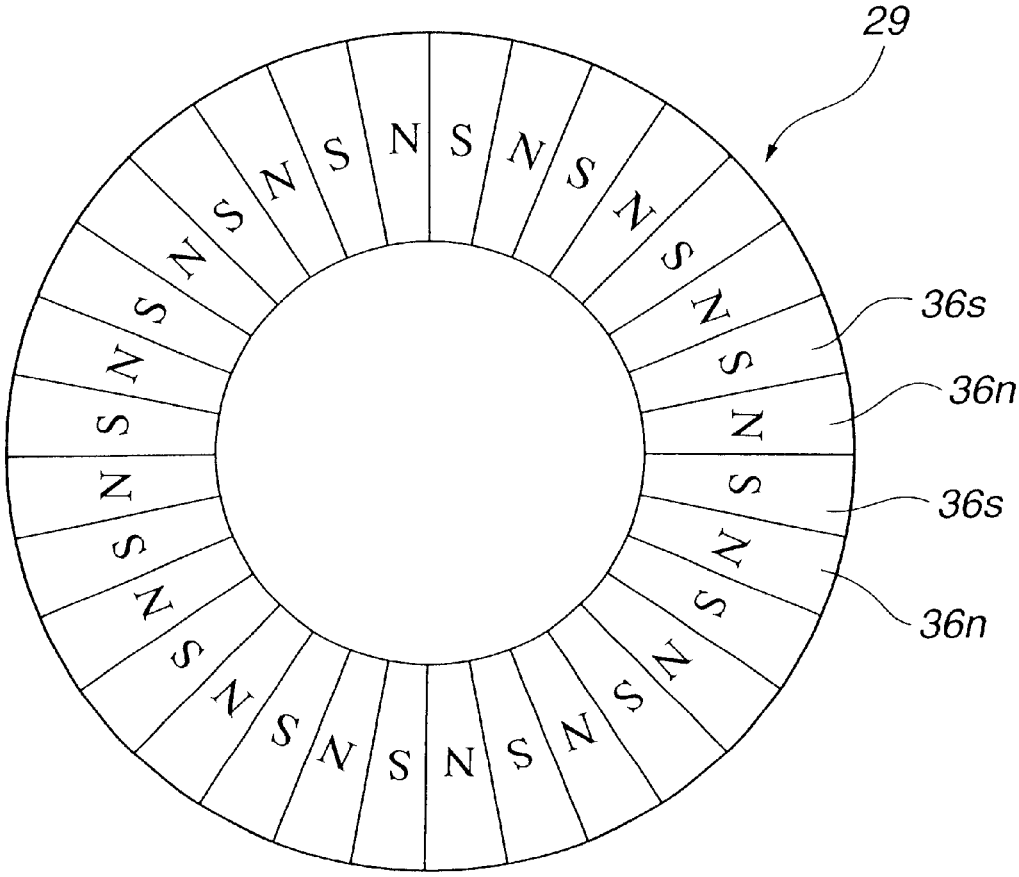
FIG. 5 is a front view showing an electromagnet block.

Referring to FIG. 5, permanent-magnet block 29 comprises a plurality of magnetic or N and S poles radially extending on a surface perpendicular to the axial direction and arranged such that different poles are located circumferentially alternately. The N and S poles have pole faces 36*n*, 36*s*.

Figure 6:
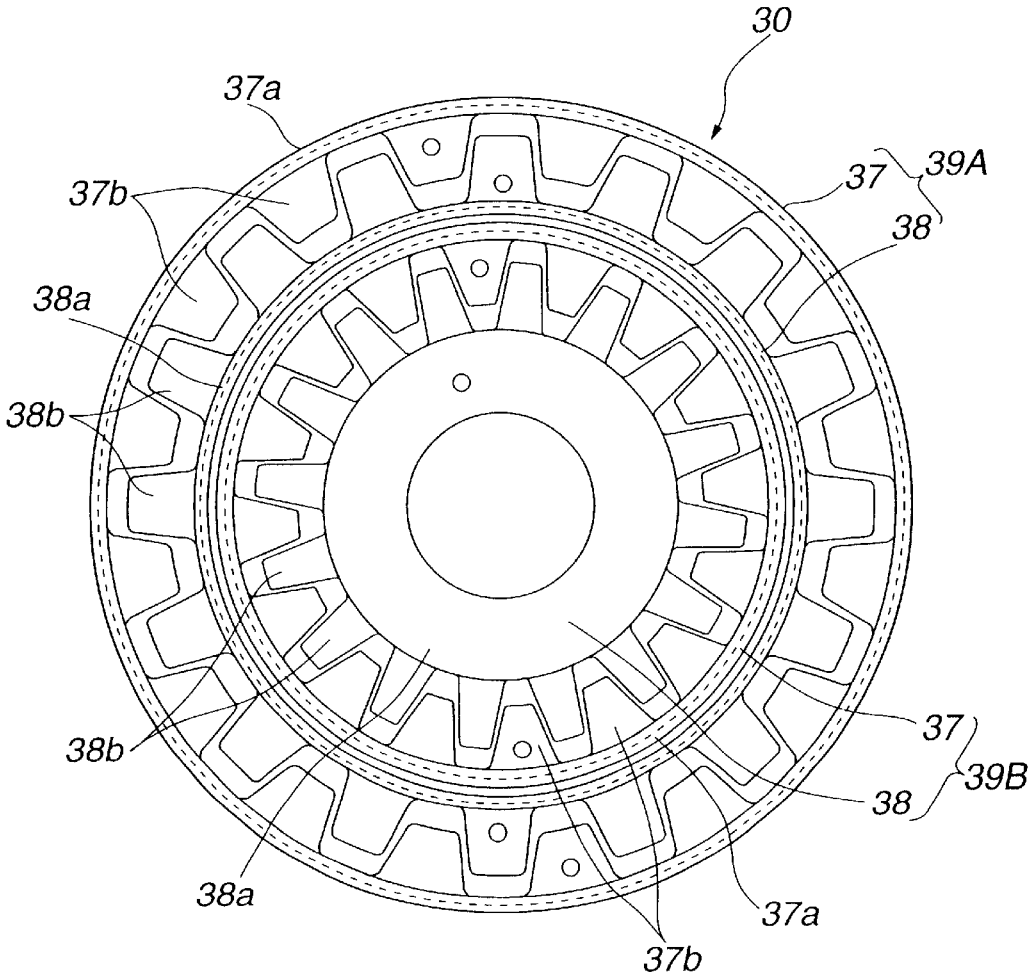
FIG. 6 is a view similar to FIG. 5, showing a yoke block with filler resin material removed.
Figure 7:
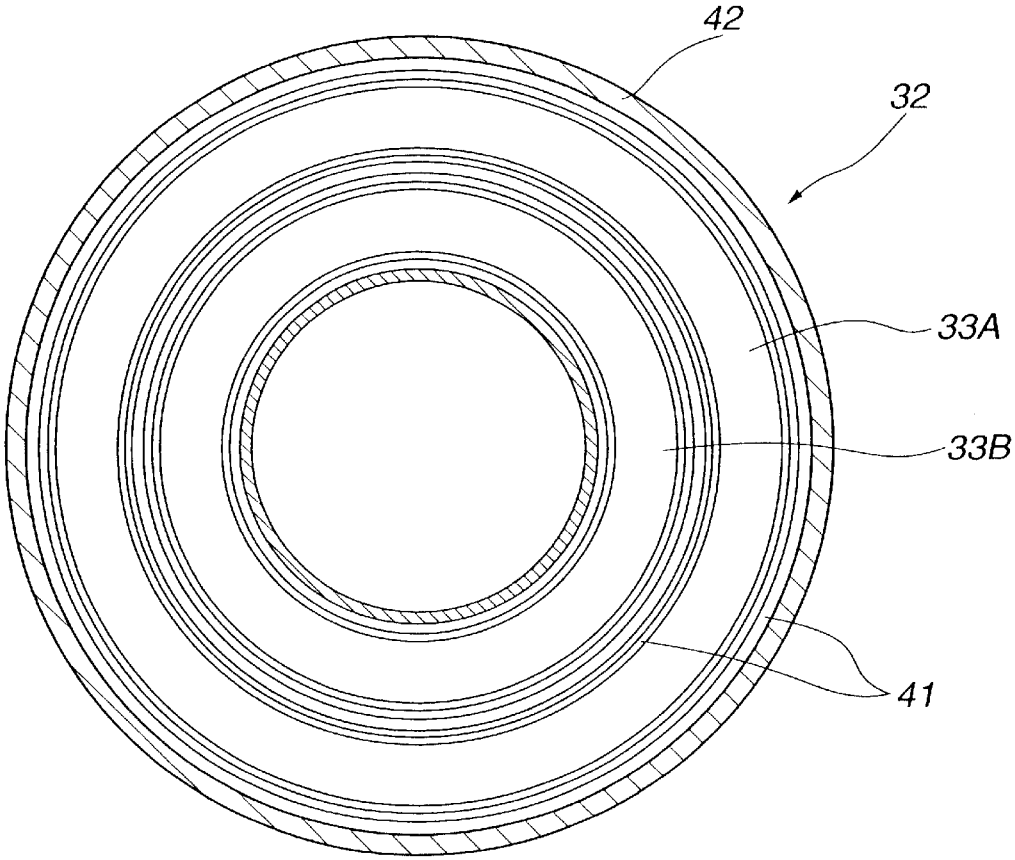
FIG. 7 is a view similar to FIG. 1, showing an electromagnetic-coil block.

Referring to FIGS. 4 and 6, yoke block 30 comprises two sets of yokes 39A, 39B, each yoke having a pair of first and second pole-teeth rings 37, 38, and has an inner peripheral edge integrally connected to lever shaft 10.

First and second pole-teeth rings 37, 38 of yokes 39A, 39B are formed out of metallic material having high permeability, and include flat-ring-like bases 37*a*, 38*a* and a plurality of roughly trapezoidal pole teeth 37*b*, 38*b* extending radially inward or outward from bases 37*a*, 38*a* as shown in FIG. 6. In this embodiment, pole teeth 37*b*, 38*b* of pole-teeth rings 37, 38 are arranged circumferentially equidistantly, the tip of which extend to face the other pole-teeth ring, i.e. the tip of first pole-teeth ring 37 extends radially inward, whereas the tip of second pole-teeth ring 38 extends radially outward. First and second pole-teeth rings 37, 38 are joined to each other by a resin material or insulator 40 so that pole teeth 37*b*, 38*b* are arranged circumferentially alternately and at the equal pitch.

Two yokes 39A, 39B constituting yoke block 30 are arranged radially outside and inside to form a disc as a whole, and are assembled so that pole teeth 37*b*, 38*b* are offset by one-fourth of the pitch along the circumferential direction.

As show in FIGS. 1 and 4, yoke blocks 30 are disposed to have both sides facing permanent-magnet block 29 and electromagnetic-coil block 32 in the axial direction. In order to locate flat-ring-like bases 37*a*, 38*a* on the side of electromagnetic-coil block 32, i.e. on the left as viewed in FIG. 4, and trapezoidal pole teeth 37*b*, 38*b* on the side of permanent-magnet block 29, i.e. on the right as viewed in FIG. 4, first and second pole-teeth rings 37, 38 of yokes 39A, 39B have connections between pole teeth 37*b*, 38*b* and bases 37*a*, 38*a* bent appropriately. Yokes 39A, 39B of yoke block 30 are joined to each other by resin material 40 in the same way as first and second pole-teeth rings 37, 38 of yokes 39A, 39B.

On the other hand, as shown in FIG. 4, electromagnetic-coil block 32 comprises two-phase electromagnetic coils 33A, 33B disposed radially outside and inside and a yoke 41 disposed in the neighborhood of electromagnetic coils 33A, 33B and for introducing magnetic flux generated in electromagnetic coils 33A, 33B into magnetic entrances 34, 35 close to yoke block 30.

Magnetic entrances 34, 35 of electromagnetic coils 33A, 33B face flat-ring-like bases 37*a*, 38*a* of yokes 39A, 39B of yoke block 30 through an axial air gap "a", respectively, as shown in FIG. 4. Therefore, when electromagnetic coils 33A, 33B are energized to generate a magnetic field in a predetermined direction, magnetic induction occurs in yokes 39A, 39B of yoke block 30 through air gap "a", resulting in emergence of magnetic poles in pole-teeth rings 37, 38 of yokes 39A, 39B in accordance with the direction of the magnetic field.

The magnetic field generated in electromagnetic coils 33A, 33B is switched in sequence in predetermined patterns with respect to input of pulses of the drive circuit. With this, the magnetic poles of pole teeth 37*b*, 38*b* opposite to pole faces 36*n*, 36*s* of permanent-magnet block 29 are moved by one-fourth of the pitch along the circumferential direction. At this time, intermediate rotator 23 follows movement of the magnetic poles along the circumferential direction of yoke block 30, causing relative rotation with respect to lever shaft 10.

Electromagnetic-coil block 32 in the roughly whole area except magnetic entrances 34, 35 is embraced by an embracing block 42 made of non-magnetic material such as aluminum, and is mounted to VTC cover 12 through embracing block 42. Moreover, a ball bearing 50 is arranged on the inner peripheral face of embracing block 42, through which block 42 is rotatably engaged with lever shaft 10.

In this embodiment, the valve timing control system is constructed as described above, so that upon engine start and during idle running, keeping in advance the mounting angle of driving plate 3 and lever shaft 10 on the maximum lag-angle side allows the phase of rotation of the crankshaft and camshaft 1, i.e. opening and closing timing of the engine valve, to be on the maximum lag-angle side, achieving stabilized engine rotation and improved fuel consumption.

In this state, when engine operation proceeds to normal running, and the ECU provides a command to the drive circuit of electromagnetic-coil block 32 so as to change the phase of rotation to the maximum advance-angle side, electromagnetic-coil block 32 switches a generated magnetic field in predetermined patterns in accordance with the command, making maximum relative rotation of permanent-magnet block 29 together with intermediate rotator 23 in the lag direction. Thus, guide member 17 engaged with spiral slot 24 through ball 19 performs maximum radially inward displacement along radial slot 8 as shown in FIGS. 8 and 9, changing the mounting angle of driving plate 3 and lever shaft 10 through link 14 and lever 9 to the maximum advance-angle side. As a result, the phase of rotation of the crankshaft and camshaft 1 is changed to the maximum advance-angle side, achieving a power increase of the engine.

On the other hand, in this state, when the ECU provides a command to change the phase of rotation to the maximum lag-angle side, electromagnetic-coil block 32 switches a generated magnetic field in reversed patterns to make maximum relative rotation of intermediate rotator 23 in the advance direction, performing maximum radially outward displacement of guide member 17 engaged with spiral slot 24 along radial slot 8 as shown in FIG. 2. Thus, guide member 17 performs relative rotation of driving plate 3 and lever shaft 10 through link 14 and lever 9 to change the phase of rotation of the crankshaft and camshaft 1 to the maximum lag-angle side.

In this embodiment, when intermediate rotator 23 is rotated as described above, ball 19 rolls in spiral slot 24 of intermediate rotator 23 to radially displace guide member 17, where ball 19 is allowed to make axial displacement in the state biased by coil spring 21, achieving smooth operation of ball 19 and guide member 17. On the other hand, guide member 17 can receive not only an operating force, i.e. force in the direction of rotation, from intermediate rotator 23, but also great torque variation due to the profile of the driving cam and a resilient force of the valve spring from camshaft 1 through link 14. Then, ball 19 undergoes a great force which can make ball 19 be involved in a circular face of spiral slot 24. In this embodiment, however, the end face of retainer 20 of guide member 17 abuts on bottom wall 18*a* of hold hole 18 to allow sure prevention of ball 19 from being disengaged from spiral slot 24, having no possibility that ball 19 is fully involved in an edge of spiral slot 24.

Thus, ball 19 is surely held in spiral slot 24 at all times, leading to stable and sure operation of guide member 17 during rotation of intermediate rotator 23. Therefore, this embodiment can realize desired valve timing control at all times.

Figure 10:
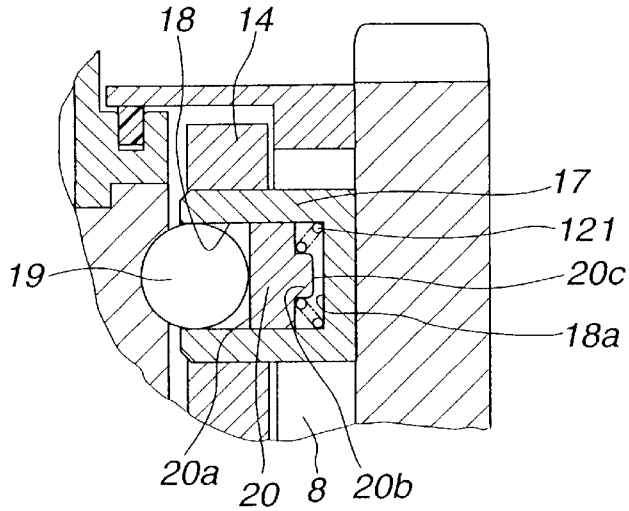
FIG. 10 is a fragmentary longitudinal sectional view showing a second embodiment of the present invention.

Having described the present invention in connection with the preferred embodiment, it is understood that the present invention is not limited thereto, and various changes and modifications can be made without departing from the scope of the present invention. By way of example, the engaging part engaged with the spiral guide is not limited to a ball, but may be a member of different shape such as a pin. Moreover, the restraining means for restraining backward displacement of the engaging part can be achieved by only setting of the spring constant of the biasing means such as coil spring. Note that when the restraining means are constructed by an abutment provided to the retainer and the like and an axially immovable restraining wall, the restraining position of the engaging part such as ball can be set and adjusted easily. Furthermore, the basing means are not limited to a coil spring, but may be a disc spring 121 as shown in FIG. 10. In this variation, a spring accommodation space can be reduced in terms of the characteristics of disc spring 121, allowing further shortening of the axial length of the system/

The entire contents of Japanese Patent Application P2001-317653 filed Oct. 16, 2001 are incorporated hereby by reference.

What is claimed is:

1. A system for controlling a valve timing in an internal combustion engine, comprising:

a driving rotator rotated by a crankshaft of the engine;

a follower rotator provided to a camshaft of the engine, the follower rotator receiving power from the driving rotator;

a radial guide provided to one of the driving rotator and the follower rotator;

an intermediate rotator arranged rotatable with respect to the driving rotator and the follower rotator, the intermediate rotator comprising a spiral guide in a face opposite to the radial guide;

a movable guide movably engaged with the radial guide and the spiral guide;

a link which swingably couples another of the driving rotator and the follower rotator at a position distant from a center of rotation thereof to the movable guide; and a device which provides to the intermediate rotator an operating force for rotation with respect to the driving rotator and the follower rotator, the device making radial displacement of the movable guide engaged with the spiral guide along the radial guide, the radial displacement being converted into relative rotation of the driving rotator and the follower rotator through the link, the movable guide comprising a main body supported by a front end of the link, an engaging part movably provided to the main body and engaged with the spiral guide, a biasing device which biases the engaging part to the spiral guide, and a restraining device which restrains, when backward displacement of the engaging part occurs against a force of the biasing device, the backward displacement within a range that the engaging part fails to be disengaged from the spiral guide.

2. The system as claimed in claim 1, wherein the spiral guide of the intermediate rotator comprises a spiral slot having a semicircular section.

3. The system as claimed in claim 2, wherein the engaging part of the movable guide comprises a ball engaged with the spiral guide in a free rolling way.

4. The system as claimed in claim 2, wherein the engaging part of the movable guide comprises a pin engaged with the spiral guide.

5. The system as claimed in claim 1, wherein the biasing device of the movable guide comprises a coil spring.

6. The system as claimed in claim 1, wherein the biasing device of the movable guide comprises a disc spring.

7. The system as claimed in claim 1, wherein the restraining device of the movable guide comprises an abutment provided to one of the engaging part and a part which is displaced with the engaging part, and an axially immovable restraining wall abutting on the abutment when the engaging part is moved backward by a given distance.

8. The system as claimed in claim 1, wherein the restraining device of the movable guide comprises the biasing device having a spring constant set to a given value.

9. A system for controlling a valve timing in an internal combustion engine, comprising:

a driving rotator rotated by a crankshaft of the engine;

a follower rotator provided to a camshaft of the engine, the follower rotator receiving power from the driving rotator;

a radial guide provided to one of the driving rotator and the follower rotator;

an intermediate rotator arranged rotatable with respect to the driving rotator and the follower rotator, the intermediate rotator comprising a spiral guide in a face opposite to the radial guide;

a movable guide movably engaged with the radial guide and the spiral guide;

a link which swingably couples another of the driving rotator and the follower rotator at a position distant from a center of rotation thereof to the movable guide; and means for providing to the intermediate rotator an operating force for rotation with respect to the driving rotator and the follower rotator, the providing means making radial displacement of the movable guide engaged with the spiral guide along the radial guide, the radial displacement being converted into relative rotation of the driving rotator and the follower rotator through the link, the movable guide comprising a main body supported by a front end of the link, an engaging part movably provided to the main body and engaged with the spiral guide, a biasing device which biases the engaging part to the spiral guide, and a restraining device which restrains, when backward displacement of the engaging part occurs against a force of the biasing device, the backward displacement within a range that the engaging part fails to be disengaged from the spiral guide.

10. An internal combustion engine, comprising:

a crankshaft;

a camshaft;

a driving rotator rotated by the crankshaft;

a follower rotator provided to the camshaft, the follower rotator receiving power from the driving rotator;

a radial guide provided to one of the driving rotator and the follower rotator;

an intermediate rotator arranged rotatable with respect to the driving rotator and the follower rotator, the intermediate rotator comprising a spiral guide in a face opposite to the radial guide;

a movable guide movably engaged with the radial guide and the spiral guide;

a link which swingably couples another of the driving rotator and the follower rotator at a position distant from a center of rotation thereof to the movable guide; and a device which provides to the intermediate rotator an operating force for rotation with respect to the driving rotator and the follower rotator, the device making radial displacement of the movable guide engaged with the spiral guide along the radial guide, the radial displacement being converted into relative rotation of the driving rotator and the follower rotator through the link, the movable guide comprising a main body supported by a front end of the link, an engaging part movably provided to the main body and engaged with the spiral guide, a biasing device which biases the engaging part to the spiral guide, and a restraining device which restrains, when backward displacement of the engaging part occurs against a force of the biasing device, the backward displacement within a range that the engaging part fails to be disengaged from the spiral guide.

* * * * *